US010227830B2

(12) United States Patent
Orban et al.

(10) Patent No.: US 10,227,830 B2
(45) Date of Patent: Mar. 12, 2019

(54) ACOUSTIC DETECTION OF DRILL PIPE CONNECTIONS

(71) Applicant: Schlumberger Technology Corporation, Sugar Land, TX (US)

(72) Inventors: Jacques Orban, Katy, TX (US); Brian Oliver Clark, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 49 days.

(21) Appl. No.: 15/142,512

(22) Filed: Apr. 29, 2016

(65) Prior Publication Data

US 2017/0314386 A1 Nov. 2, 2017

(51) Int. Cl.
*E21B 17/01* (2006.01)
*E21B 47/09* (2012.01)
*E21B 47/08* (2012.01)

(52) U.S. Cl.
CPC ..... *E21B 17/01* (2013.01); *E21B 47/082* (2013.01)

(58) Field of Classification Search
CPC ..... E21B 47/091; E21B 17/01; E21B 17/04; E21B 33/061; E21B 47/082
USPC ..... 367/33
See application file for complete search history.

(56) References Cited

U.S. PATENT DOCUMENTS 7,274,989 B2 * 9/2007 Hopper ..... E21B 41/00 166/255.1
9,605,532 B2 * 3/2017 Cayeux ..... E21B 47/09

FOREIGN PATENT DOCUMENTS

WO WO2017065961 4/2017

OTHER PUBLICATIONS

RPSEA, "Intelligent BOP RAM Actuation Sensor Systems", [http://www.rpsea.org/media/files/files/c20df19e/DCI-PR-11121-5503-01_Intelligent_BOP_RAM_Auction_Sensor_Systems-Andarawis-01-29-14.pdf], retrieved Feb. 2, 2018, 24 pages.

* cited by examiner

*Primary Examiner* — Daniel L Murphy

(57) ABSTRACT

A system for determining a location and a diameter of a pipe deployed in a bore includes a plurality of circumferentially spaced acoustic transmitters and a plurality of circumferentially spaced acoustic receivers deployed in a wall of the bore. A processor is configured to identify and process received acoustic waveforms that are reflected by the pipe to compute the location and the diameter of the pipe. The system may include a drill string deployed in a drilling riser.

19 Claims, 11 Drawing Sheets

ACOUSTIC DETECTION OF DRILL PIPE CONNECTIONS

CROSS REFERENCE TO RELATED APPLICATIONS

None.

FIELD OF THE INVENTION

Disclosed embodiments relate generally to drilling risers used in offshore drilling operations and more particularly to an acoustic method and apparatus for detecting drill pipe connections deployed in a drilling riser.

BACKGROUND INFORMATION

Offshore drilling rigs may operate at water depths exceeding 10,000 feet. When operating with a floating drilling unit (such as a drill ship or a semisubmersible drilling rig), the blowout preventers (BOPS) are generally located on the seafloor (rather than on the rig). The region between the BOP and the drilling rig is bridged by a series of large diameter tubes that are mechanically coupled to one another and make up the drilling riser. During a drilling operation the drill string is deployed in the drilling riser, with drilling fluid occupying the annular region between the drill string and the riser wall.

In a well control situation, formation fluids and/or gas can enter the well bore and may potentially result in a blowout if not properly controlled. The BOP commonly employs at least one mechanism for sealing the drill pipe in the event of formation fluid ingress. For example, pipe-rams may be used to seal against the drill-pipe. Some pipe-rams may preferably seal against the tubular section of the drill-pipe or are only able to seal against the tubular section of the drill-pipe, as they are specialized for such diameter.

In severe cases, in which sealing the drill pipe is inadequate, the final defense against a blowout may be to sever the drill pipe with a shear ram such as a blind shear ram (BSR) or a casing shear ram (CSR). These rams employ steel blades driven by hydraulic pistons to cut through the drill pipe and seal off the BOP bore. The rams and pistons are suitably strong to shear the tubular section of the drill pipe, but are not generally capable of shearing the drill pipe connections (located between the tubular sections) due to the significantly increased wall thickness of the connection. Thus, in the event that the drill pipe connection is located in the BSR or CSR, the drill pipe cannot be cut and the well cannot be properly sealed. There is therefore a need in the art for a method and apparatus capable of locating the drill pipe connections with respect to the BSR and CSR in a subsurface BOP.

SUMMARY

A system for determining a location and a diameter of a pipe deployed in a bore is disclosed. The system includes a plurality of circumferentially spaced acoustic transmitters and a plurality of circumferentially spaced acoustic receivers deployed in a wall of the bore. A processor is configured to identify and process received acoustic waveforms that are reflected by the pipe to compute the location and the diameter of the pipe. In preferred embodiments, the bore is disposed in a drilling riser, a lower marine riser package, or a blowout preventer and the pipe includes a drill pipe. The processor may be configured to identify a drill pipe connection when the diameter of the pipe is greater than a predetermined threshold diameter or based upon a change in the diameter of the pipe when the pipe is moved axially in the bore.

The disclosed embodiments may provide various technical advantages. For example, disclosed embodiments provide a system for determining the diameter and location of a pipe such as a drill string in a bore such as a drilling riser or blowout preventer. The system is intended to identify the location of drill string connections thereby ensuring that pipe rams or shear rams can adequately seal or shear the drill string in the event of an imminent blow out. Moreover, by determining the location or eccentricity of the pipe in the bore, the system may alert drilling personnel to devise specific actions to center the pipe prior to actuating the pipe or shear rams. The system may also identify drill string components having noncircular shapes, such as stabilizers and the like.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
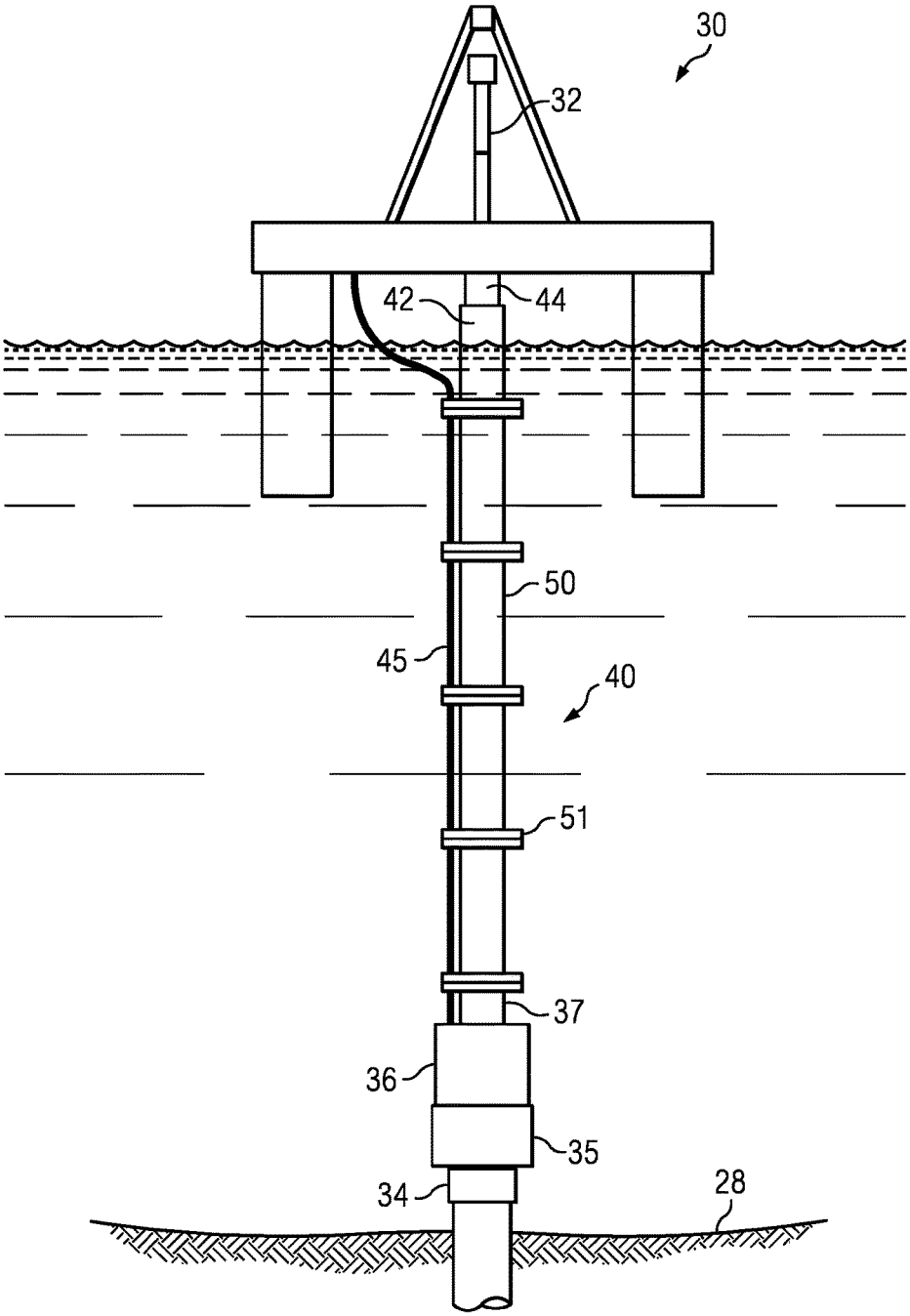
FIG. 1 (PRIOR ART)
FIG. 1 depicts a floating offshore drilling rig employing a prior art drilling riser.

FIG. 1 depicts a floating offshore drilling rig 30 employing a prior art drilling riser 40. During a conventional drilling operation, drilling fluid (commonly referred to as "mud") is pumped downhole through a drill pipe 32 and various drilling tools before flowing out through jets mounted in the drill bit (not shown). In the region of the wellbore located below the sea floor 28, the mud carries cuttings back to the drilling rig in the annular space between the drill pipe and the borehole or casing. In the region between the sea floor 28 and the drilling rig 30, the drill string (and therefore the mud and cuttings) are contained in the drilling riser 40. The well-head 34 is connected to the top of the well via one casing. The BOP 35 is connected to the well-head 34. The drilling riser is coupled to the blow out preventer (BOP) 35 via a lower marine riser package (LMRP) 36 and a lower flex joint 37, which allows the drilling riser to be tilted at a small angle (if necessary). The drilling riser 40 is generally connected to the drilling rig 30 (e.g., a floating rig) via a telescoping riser slip joint 42 configured to accommodate heave and tide. The drilling riser 40 is generally maintained under tension to provide a mostly straight and vertical alignment (referred to in the art as a top tensioned riser). An upper flex joint 44 allows the slip joint 42 to be offset slightly from vertical. Drifting off location can also increase the tension on the riser to the point where the tensioner is locked out. A kill line 45 may connect the rig to the LMRP 36 and/or to BOP 35. A choke line (not shown) may further connect the BOP to the rig.

Those of ordinary skill in the art will understand that the drilling riser 40 is substantially vertical, but that small angle deviations (e.g., on the order of one or two degrees) can often be tolerated. Further deviation may damage the LMRP 36, the BOP 35, and/or the riser slip joint 42. The drilling riser 40 is commonly made up of a large number of coupled riser sections 50 (e.g., clamped or bolted to one another as shown at 51).

Figure 2:
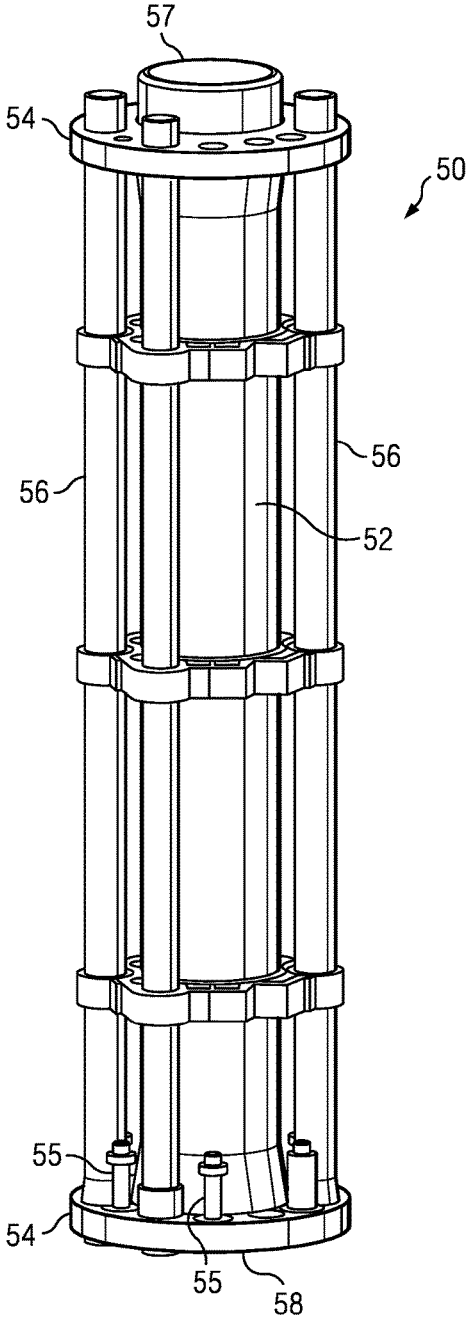
FIG. 2 (PRIOR ART)
FIG. 2 depicts one of the riser sections deployed in the drilling riser shown on FIG. 1.

FIG. 2 depicts one of the prior art riser sections 50 deployed in the riser shown on FIG. 1. Individual riser sections are commonly very large and heavy. For example, each riser section 50 may be up to about 90 feet long, such that a water depth of 10,000 feet can require over 100 riser sections 50. A large central tube 52 (also referred to as the riser tube) receives the drill string 32 (FIG. 1) and the return flow of drilling mud. The central tube 52 generally has a diameter significantly greater than that of the drill pipe, for example, a 21 inch outer diameter and a 19.5 inch inner diameter. Prior art riser sections 50 commonly include flanges 54 located at their axial ends for connecting to one another (such as via bolts 55). Alternatively, some riser sections may use a clamping system including numerous "dogs" to lock the riser sections together. The riser sections 50 commonly further include a number of smaller high pressure hydraulic auxiliary tubes 56 (e.g., three in the depiction) rigidly connected to the flanges. These auxiliary tubes 56 may include kill, choke, and boost lines and generally have a diameter in a range from about two to six inches. The auxiliary tubes 56 connect the drilling rig 30 to the BOP 35 and LMRP 36. These rigid auxiliary tubes 56 commonly end below the riser slip joint 42 (FIG. 1) and may be connected to the rig via flexible hydraulic lines.

Figure 3:
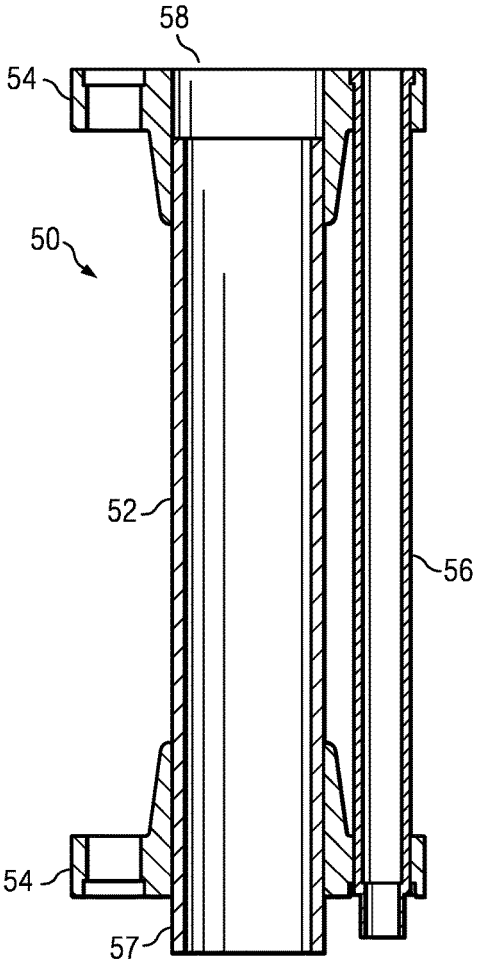
FIG. 3 (PRIOR ART)
FIG. 3 depicts a cross-sectional view of the riser section shown on FIG. 2.

FIG. 3 depicts a cross-sectional view of the riser section 50 shown on FIG. 2. During make-up of a riser string (the drilling riser 40), the riser sections 50 that have already been made-up may be suspended below the rig floor (e.g., in the sea), with the box end 58 of the central tube 52 facing upwards. The next riser section 50 is brought up in the derrick with the pin end of the central tube 52 facing downwards. Upon alignment of the box and pin ends of the riser tube (as well as the box and pin ends of the auxiliary tubes), the upper riser section is lowered until fully engaged with the made up string. The flanges 54 may then be bolted together. The presence of the hydraulic lines 56 does not interfere with assembling or disassembling, and hence does not generally add to the tripping time. Since three or more auxiliary lines are commonly employed, mechanical alignment of these tubes is critical thereby requiring very tight manufacturing tolerances.

Commonly assigned and commonly invented U.S. Provisional Patent Application Ser. No. 62/242,091, which is incorporated by reference herein in its entirety, discloses an intelligent riser that includes a high speed two-way communication system employing inductive couplers at each of the flange couplings. The intelligent riser may further include a plurality of sensors distributed axially along the length of the riser. The communication system may provide electronic communication between the sensors and a surface electronics module located on the rig.

Figure 4:
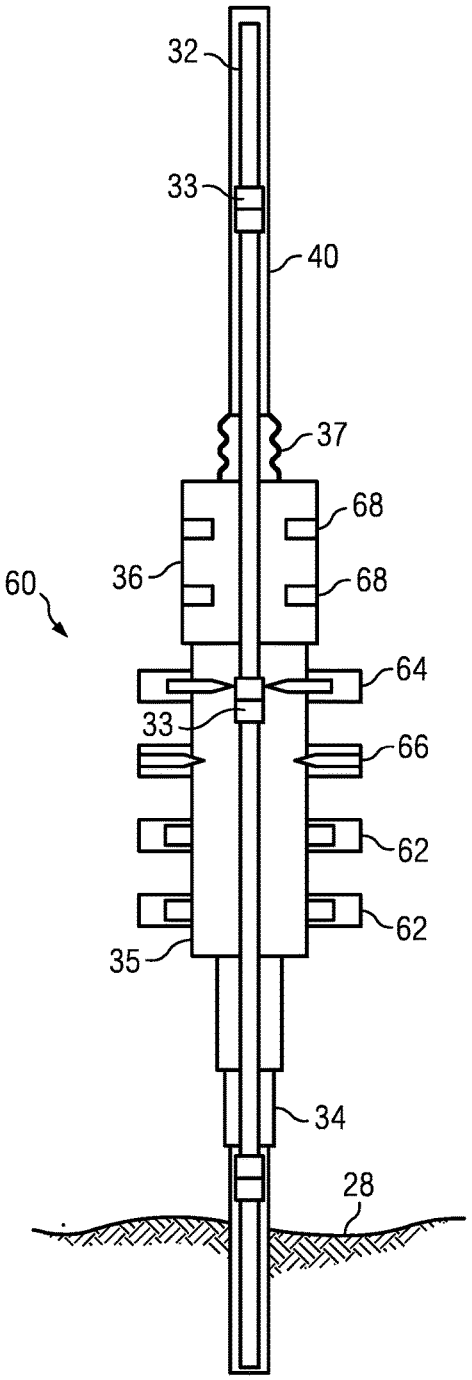
FIG. 4 depicts a floating offshore drilling rig suitable for using various apparatus and method embodiments disclosed herein including one disclosed drilling riser embodiment.

FIG. 4 depicts drill pipe 32 inside subsea stack 60. As described above with respect to FIG. 1, the subsea stack 60 may include a LMRP 36 and a BOP 35 deployed above wellhead 34 and below flex joint 37. In the depicted embodiment, BOP 35 may include one or more variable bore rams (VBR) 62 configured to seal around the drill pipe. The BOP 35 may further include a blind shear ram (BSR) 64 and/or a casing shear ram (CSR) 66 configured to shear the drill pipe 32. The drill pipe 32 includes conventional tubulars 32 coupled together via connections 33 (also referred to in the art as joints or tool joints) as described in more detail below.

In a well control situation, formation fluids and/or gas can enter the well bore and may potentially result in a blowout if not controlled. The BOP 35 is configured to prevent a blowout from occurring. For example, in the event of an influx of formation fluid into the well, the first defense is generally to close the annular preventer(s) 68 in the LMRP 36 or BOP 35 which is intended to seal the outside of the drill pipe. If the annular preventer 68 sets properly, then the driller can open the choke line and bleed off the pressure while injecting heavy mud through the kill line.

The variable bore rams 62 in the BOP 35 may also be used to seal around the drill pipe 32. It is generally preferable to close the VBR 62 on the tubular section 32 of the drill-pipe 32, and not on the connecter 33 (the "tool-joint"), as the cylindrical surface is longer and smoother.

In the event that sealing the drill pipe fails, the final defense against a blowout is commonly to sever the drill pipe with BSR 64 or the CSR 66. The BSR and CSR include strong steel blades driven by hydraulic pistons and are thus configured to cut through the drill pipe and seal off the well. While the BSR 64 and CSR 66 are configured to shear the tubular section, they are not generally capable of shearing the pipe connection 33 as the wall thickness of the connection 33 is generally several times greater than that of the tubular 32. For example, for a conventional 5-⅞ inch pipe the tubular wall thickness is about 0.181 inch versus a wall thickness of 1.240 inches for a corresponding XT57 connection. Thus, if the drill pipe connection 33 is located in the BSR or CSR, then the drill pipe cannot generally be sheared and the well cannot be sealed.

In response to an influx of formation fluids (a "kick"), a driller commonly attempts to "space" the drill pipe so that the drill pipe connection is not located in the BSR or CSR. The driller may then close an annular preventer or a VBR. However, the exact location of the drill pipe connections in the vicinity of the BOP may not be known with high enough accuracy. Furthermore, the drill pipe may be moving up and down due to the heave affecting the floating platform (e.g., such a situation may occur when the rig heave compensation for the drill string is not activated). While the driller maintains a "tally" that lists the position of each section of drill pipe and its length, the length of the drill string can vary. For example, drill pipe lengths vary slightly. In a deepwater well, there may be as much as 10,000 feet of drill pipe between the mobile offshore drilling unit (MODU) and the BOP. Such a depth requires 312 sections of 32 foot long drill pipe just to reach the seafloor. A systematic error of only 0.1 inch per length of drill pipe accumulates to over 30 inches of error. Moreover, there are other potential sources of error, such as heave and tide effect on the MODU, thermal expansion/contraction of the drill pipe, pipe stretch under tension, stretch of the cable between the draw-works and the travelling block, and drill pipe buoyancy in heavy muds. Another potential source of error is the measurement of hook height above the rig floor (which can vary).

Furthermore, it should be noted that when the drill-string is not on bottom, most drill-string tensionmeters are typically fully extended such that the drill-string moves up and down with the vertical movement of the MODU imposed by the heave. In the case of large heave, this movement may be 15 feet or more, while the period of the heave movement can be as short as 15 seconds. Under these circumstances, the conventional determination of the presence of a drill pipe connection can be exceedingly problematic.

Additionally, high pressure oil and gas in a kick can force the drill string towards the surface. For example, in the 2010 Macondo blowout, the BOP was moved towards the surface such that even an extremely accurate depth system would not have been able to locate the position of the drill pipe connections with respect to the BSR.

With continued reference to FIG. 4, a drill pipe connection 33 is depicted as being located in the BSR 64. Given the uncertainty in the exact position of connections 33, the driller may be forced to guess or "take a chance" that the thin walled tubular section is in the BSR 64. For the above described 5-⅞ inch pipe employing XT57 connections, the odds of the connection randomly being in the BSR is about 7.6% (the connection is about 29 inches in length as compared to a tubular length of 32 feet). Although this is a small percentage, the consequences of trying to cut through a drill pipe connection are severe (e.g., a blowout). Given the difficulties in locating the connections, some jurisdictions require that the BOP have two distinct and spaced apart sets of blind shear rams such that one is always adjacent to the thin walled tubular. However, some existing BOPs cannot be upgraded to include two BSR sets.

Moreover, when closing the pipe-rams, it may be important for the drill-string to be sufficiently close to the center of the BOP such that the "slots" of the rams can engage the drill string. One common method for centralizing the tubular is to close first the annular preventer to push the drill string at the center. A sensing method capable of verifying the position of the center of the tubular in relation with the bore of the BOP or riser components would be advantageous.

Still further, some drill string tubulars do not have a smooth (or circular) outer surface, for example, those having axial or spiral stabilizer blades or other similar structures. The annular preventers may have difficulty sealing against such non-circular tubulars. The ability to sense the presence of such tubulars in or near the BOP may also be of value.

Acoustic Sensor Embodiments

Figure 5:
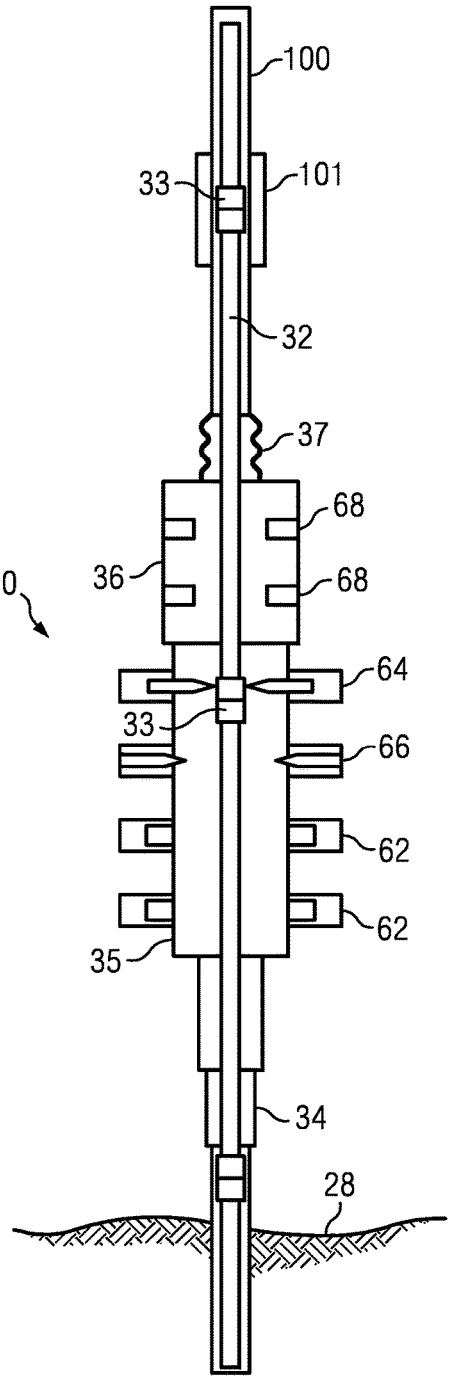
FIG. 5 depicts one embodiment of an acoustic drill pipe sensor 100 deployed in a drilling riser.

One aspect of the disclosed embodiments is the realization that the drill pipe connection may be detected using sensors in the vicinity of the BOP 60. Such sensors may be attached to, above or within the BOP as well as being spaced apart from the BOP, for example, by one, two, three, or more pipe lengths away from the BSR or CSR. FIG. 5 depicts one embodiment of drilling riser 100 including acoustic sensors (which are depicted schematically at 101). In the depicted embodiment, the sensors 101 are deployed above the subsea stack 60 in the lowermost riser section just above the BOP 35 (e.g., one pipe length above the BSR 64 in the depicted example). As described in more detail below the sensors 101 are configured to measure the diameter of the adjacent drill pipe and thus determine whether or not a drill pipe connection (joint) is located adjacent to the sensors 101. The sensors 101 may also be configured to determine the position of the center of the tubular in relation to the center of the sensor 101. Furthermore, the sensors 101 may be configured to determine if the tubular has a non-circular shape. In the event of a kick, the drilling operator may determine whether or not a drill pipe connection 33 is located adjacent the sensors 101 and if necessary move the drill string such that the connection is not in the vicinity of the sensors 101.

In an alternative embodiment, the acoustic drill pipe sensor may be located a half pipe length above the BSR (e.g., one half, three halves, five halves, etc. above the BSR). In such an embodiment, the drilling operator may elect to move the drill string such that the connection 33 is located adjacent to the acoustic sensors, thereby ensuring that a central region of a length of drill pipe is located adjacent to the BSR (or CSR). In another alternative embodiment, the acoustic drill pipe sensor may be located inside the BOP 35 or the LMRP 36.

With continued reference to FIG. 5, it will be understood that the disclosed embodiments are not limited merely to drilling riser embodiments or even to downhole embodiments. Rather, the disclosed embodiments may be directed to substantially any system in which a pipe is deployed in a bore and in which a plurality of acoustic sensors are deployed in the wall of the bore. Moreover, while the embodiments described below with respect to FIG. 6 and following are described with respect to an example drilling riser system, they may also be understood to depict and described a more generic system involving a pipe deployed in a bore.

Figure 6:
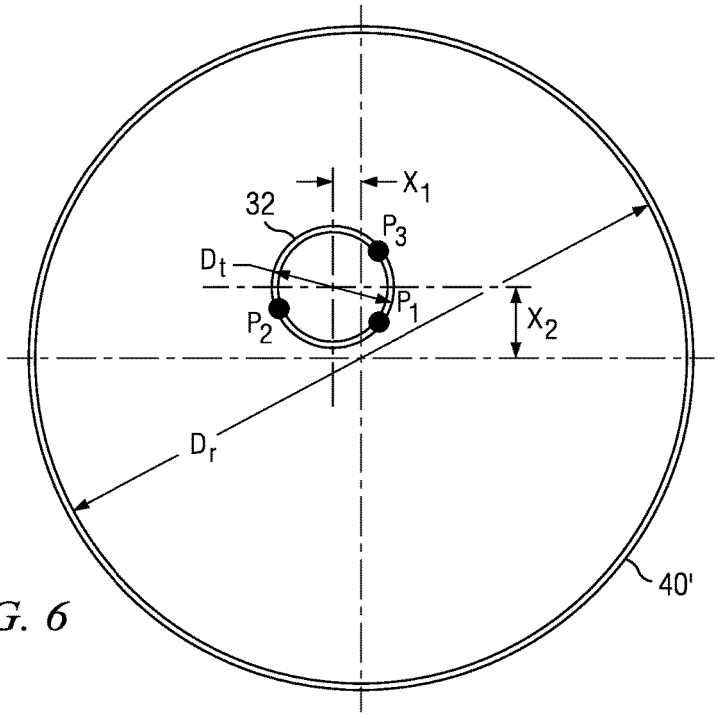
FIG. 6 depicts a cross sectional schematic view of a drill pipe in a riser section.

FIG. 6 depicts a cross sectional schematic view of drill pipe 32 in a riser section 100. The diameters of the drill pipe and riser section are indicated by $D_t$ and $D_r$. In the depicted embodiment, the drill pipe 32 is off-centered (eccentered), with its center be located at $x_1$, $x_2$. Three points $p_1$, $p_2$, and $p_3$ are also shown on the circular drill pipe 32 indicating that the location and size (diameter) of a circle may be determined by 3 points. As is apparent to those of ordinary skill in mathematics, these three points are preferably spaced about the circumference of the circle.

Figure 7:
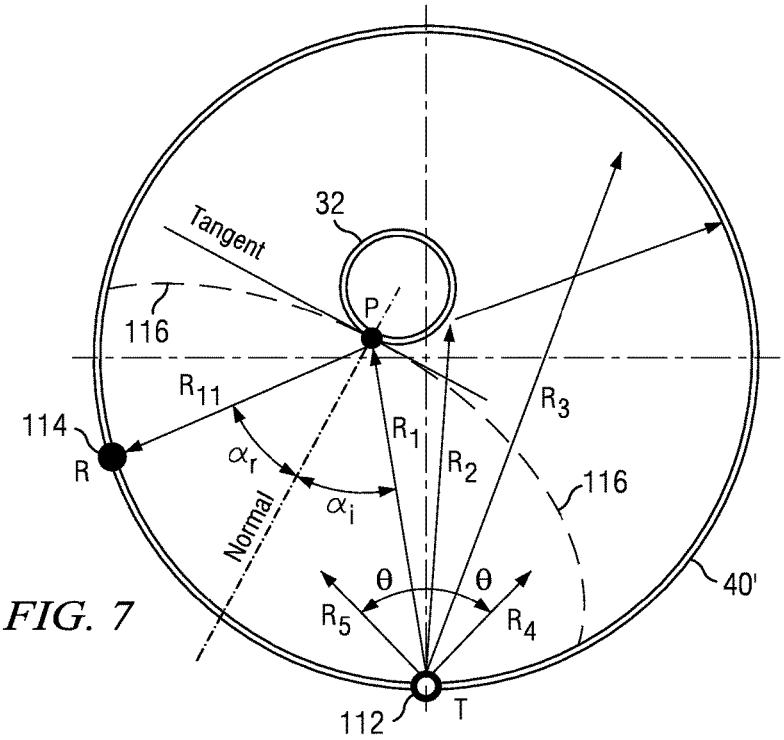
FIG. 7 depicts the riser section shown on FIG. 6 further including an acoustic transmitter and an acoustic receiver deployed on the wall of the riser section.

FIG. 7 depicts the cross sectional schematic view of the drill pipe 32 in riser section 100 shown in FIG. 6 further including an acoustic transmitter T 112 and an acoustic receiver R 114 deployed on the wall of the riser section 100. The transmitter 112 may be configured to transmit acoustic rays over a wide angular coverage. Such transmitted rays are shown as $R_1$, $R_2$, $R_3$, $R_4$, and $R_5$ in which rays $R_4$ and $R_5$ define the beam width, characterized by the angle θ. As depicted, transmitted ray $R_1$ impinges upon the tubular at point P and reflects as ray $R_{11}$ towards the receiver 114 such that the incident angle $\alpha_i$ equals the reflected angle $\alpha_r$. Note that the incident and reflected angles are measured with respect to the normal line N which is orthogonal to the tangent of the circle at point P (such that the normal line passes through the center of the circular tubular).

It will be understood that the sum of the distances between the transmitter and receiver and point P may be determined by a time of flight measurement such that:

$$L_{TPR}=T_{TPR}\cdot C \tag{1}$$

where $L_{TPR}$ represents the distance travelled by the acoustic wave (i.e., from the transmitter 112 to point P and then to the receiver 114), $T_{TPR}$ represents the time of flight of the acoustic wave from transmission to reception (as it travels from the transmitter 112 to point P and then to the receiver 114) and C represents the speed of sound in the fluid inside the riser section 100. As further depicted on FIG. 7, a constant valued $L_{TPR}$ between the transmitter 112 and the receiver 114 defines an ellipse 116 in which the transmitter and receiver are located at the two focal points of the ellipse.

Based on the known mathematical properties of an ellipse, it will be understood that substantially any circle tangent to the ellipse may satisfy the single time of flight measurement used to define the ellipse. Accordingly, a plurality of independently derived (measured) ellipses obtained from a plurality of independent acoustic measurements may be required to define the size and location of the drill pipe 32.

Figure 8:
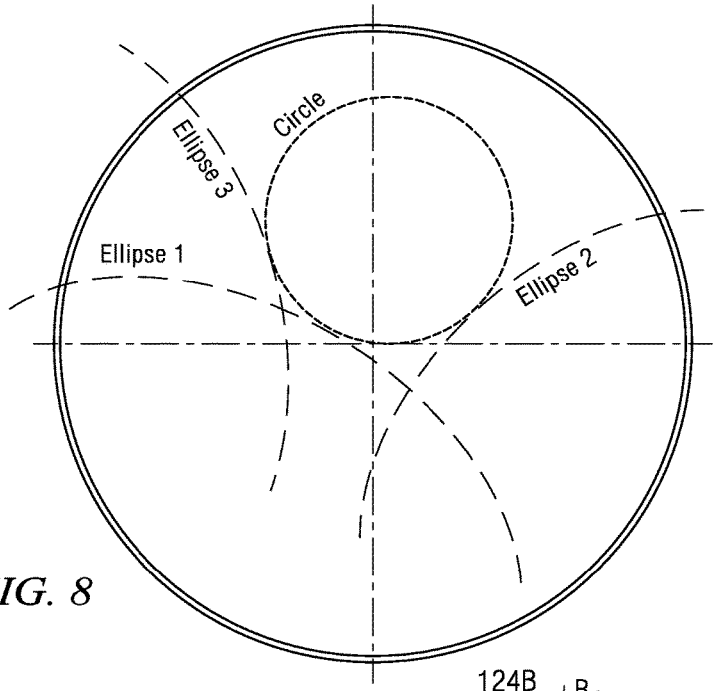
FIG. 8 depicts a schematic illustration indicating that the size and location of a drill pipe in a riser section may be defined by three independent ellipses.

FIG. 8 depicts a schematic illustration indicating that the size and location of a circle may be defined by three independent ellipses (which are obtained from three independent time of flight measurements). Note that in this example, the circle is tangent with each of the ellipses. Three independent ellipses may be obtained using a variety of acoustic measurement systems, the systems including, for example, (i) at least one transmitter and at least three receivers, (ii), at least three transmitters and at least one receiver and (iii) at least three pairs of transmitters and receivers. The disclosed embodiments are, of course, not limited to such embodiments.

Figure 9:
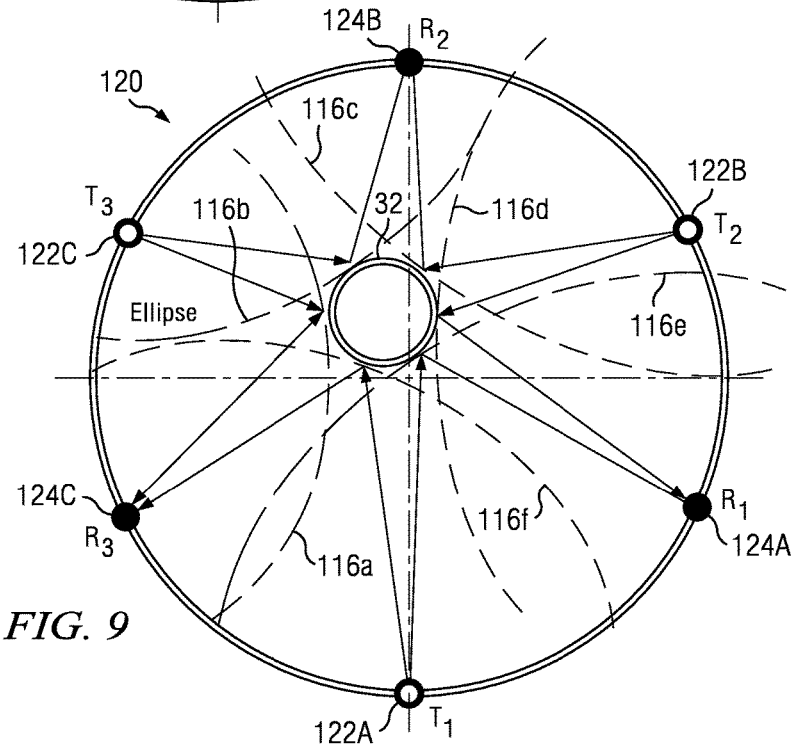
FIG. 9 depicts one example riser embodiment including three acoustic transmitters T1, T2, and T3 and three acoustic receivers R1, R2, and R3 deployed on the riser wall.

FIG. 9 depicts one example riser embodiment 120 including three acoustic transmitters T1, T2, and T3 (122A, 122B, and 122C) and three acoustic receivers R1, R2, and R3 (124A, 124B, and 124C) deployed on the riser wall. In the depicted embodiment, the transmitters T1, T2, and T3 and the receivers R1, R2, and R3 are circumferentially spaced at approximately equal angles about the periphery of the riser 120. For example, transmitter T1 is spaced about 60 degrees from receive R1 which is spaced about 60 degrees from transmitter T2, and so on. With such a construction, each receiver may receive acoustic waves from corresponding neighboring transmitters, thereby resulting in six transmitter receiver pairs. For example, receiver R1 may receive acoustic waves from transmitters T1 and T2, while receiver R2 may receive acoustic waves from transmitters T2 and T3, and receiver R3 may receive acoustic waves from transmitters T1 and T3.

FIG. 9 further illustrates six independent ellipses 116*a*, 116*b*, 116*c*, 116*d*, 116*e*, and 116*f* that may be obtained from the six transmitter receiver pairs. As described above these ellipses may be obtained from corresponding time of flight measurements. The position of the drill pipe 32 may be obtained, for example, by computing the best fit between the six ellipses. Moreover, certain ones of the ellipses may be rejected for various reasons, such as when the location of the drill pipe is too close to a particular receiver or when a signal to noise ratio of the received acoustic wave exceeds a predetermined threshold.

Figure 10:
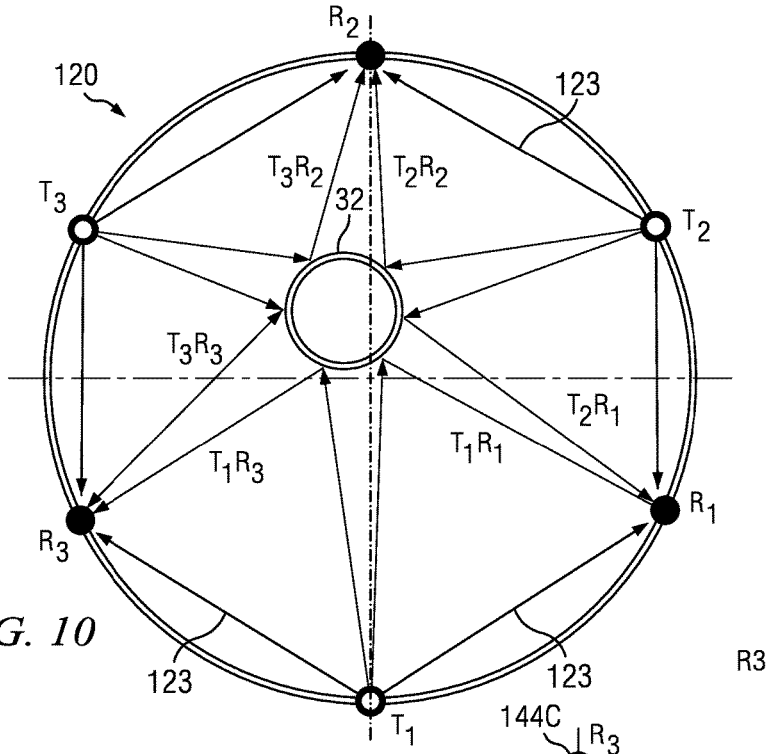
FIG. 10 depicts the example riser embodiment shown on FIG. 9 and further depicts acoustic wave paths between the transmitters and the receivers.

FIG. 10 depicts the example riser embodiment 120 shown on FIG. 9 and further depicts acoustic wave paths between the transmitters T1, T2, and T3 and the receivers R1, R2, and R3. The paths of interest are those that reflect off the drill pipe 32. However direct paths 123 between the transmitters and adjacent receivers (e.g., between T1 and R1 and T1 and R3) may also exist depending on the transmitter beam width. Such a direct path may be advantageously utilized to measure the speed of sound in the riser fluid, for example, as follows:

$$C=T_{DP}/L_{DP} \tag{2}$$

where C represents the speed of sound in the riser fluid, $T_{DP}$ represents the time of flight across the direct path, and $L_{DP}$ represents the known length of the direct path. The configuration depicted on FIGS. 9 and 10 enables six independent sonic speed measurements to be acquired. These measurements may be averaged, for example, to obtain a sonic speed value. It will be appreciated that knowledge of the sonic speed may enable an operator to determine the diameter of the circle (the diameter of the drill pipe). The position (location) of the center of the circle in the drilling riser is not generally affected by the sonic speed. Relative determination of pipe diameter may therefore not necessarily require the sonic speed determination and may be sufficient for recognition of the change in diameter between a tool joint and drill pipe section.

As is known to those of ordinary skill in the art, the drill string is frequently rotating in the riser (as well as in the wellbore), for example, during a drilling operation. Such rotation can cause the fluid in the riser to rotate with the drill string (via a phenomenon referred to as Couette rotation flow). The configuration depicted on FIGS. 9 and 10 advantageously enables any effects on the speed of sound measurements due to fluid rotation to be averaged out, for example, via averaging measurements made in a clockwise direction with those made in a counter clockwise direction.

Figure 11:
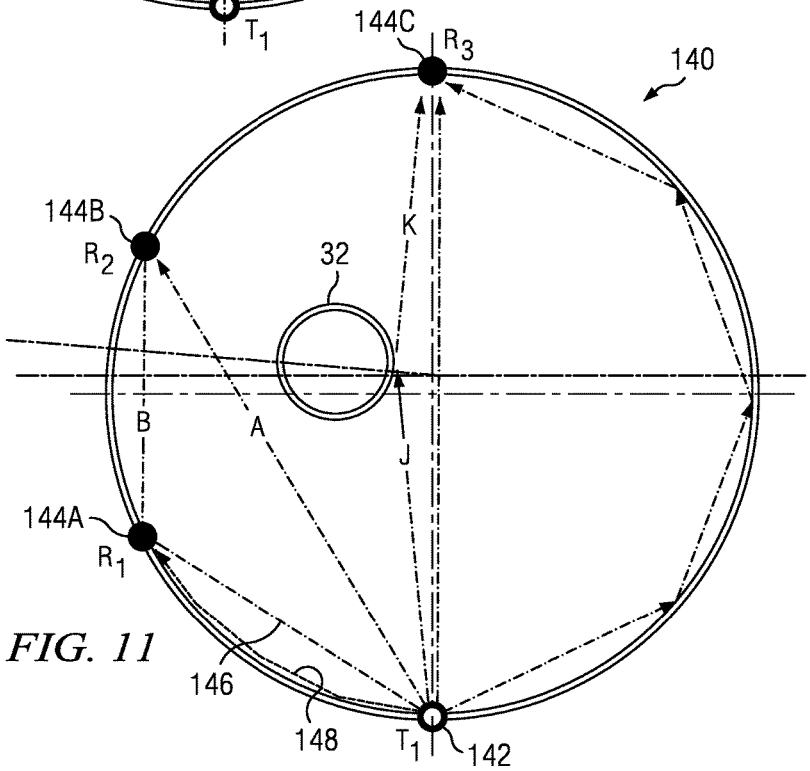
FIGS. 11 and 12 depict cross sectional views of alternative riser section embodiments, each of which includes a single transmitter and multiple receivers.
Figure 12:
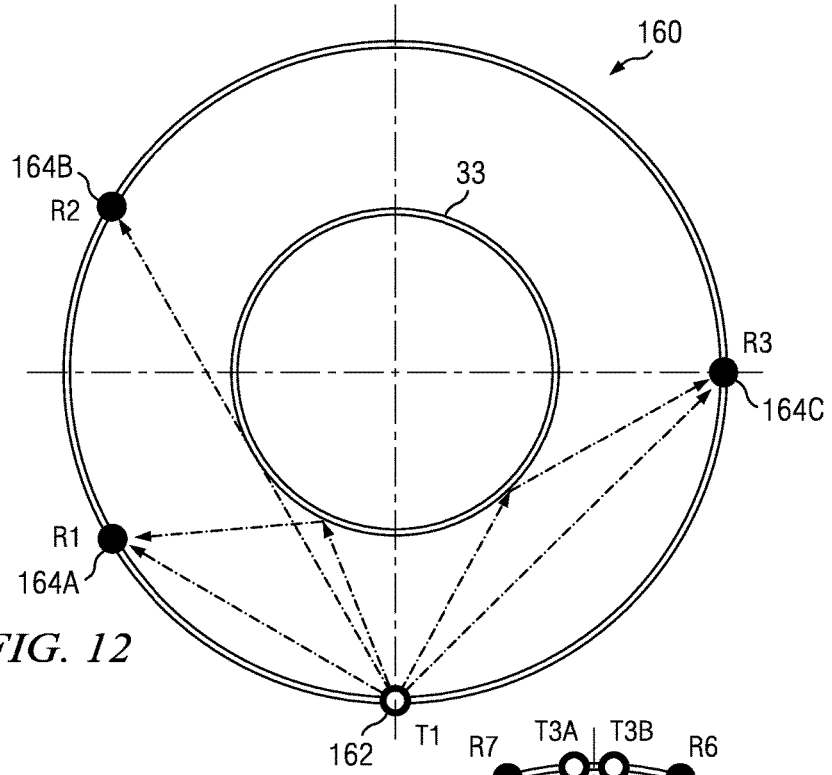

FIGS. 11 and 12 depict cross sectional views of alternative riser section embodiments 140 and 160, each of which includes a single transmitter T1 142 and 162 and multiple receivers R1, R2, and R3 144A-C and 164A-C. In the embodiment 140 depicted on FIG. 11, the receivers R1, R2, and R3 are circumferentially spaced from the transmitter T1 by 60, 120, and 180 degrees. In the embodiment 160 depicted on FIG. 12, the receivers R1, R2, and R3 are circumferentially spaced from the transmitter T1 by 60, 120, and 90 (or negative 90) degrees. Various acoustic ray paths are also depicted between the transmitters 142 and 162 and receivers 144A-C and 164A-C.

It will be understood that there are multiple (essentially infinite) acoustic ray paths between the transmitter and any particular receiver. For example, acoustic rays may travel directly through the fluid from transmitter 142 to receiver 144A (FIG. 11) as depicted by path 146. Alternatively, the acoustic rays may travel a longer path along the riser wall (via multiple reflections off the wall) as depicted at 148. Depending on the impulse length and frequency of the transmitted acoustic signal and the system geometry, there may be interference (constructive or destructive) between various ray paths. For example, acoustic rays traveling along path 146 may destructively interfere with acoustic rays traveling along path 148 resulting in minimal signal reception at receiver 144A.

Such interference may be problematic in making acoustic speed measurements. It may therefore be desirable in certain embodiments (e.g., embodiments in which the riser diameter is about 20 inches and the acoustic frequency is about 50 kHz) to utilize transmitter receiver combinations having larger circumferential spacing (e.g., greater than about 60 degrees). Due to potential shielding by the drill pipe 32 or connection 33 (e.g., as depicted on FIG. 12) it may also be desirable to utilize transmitter receiver combinations having a circumferential spacing of less than about 120 degrees.

With continued reference to FIGS. 9-12, acoustic transmitters 122A-C, 142, and 162 may be configured to generate an acoustic signal having a frequency of less than about 100 kHz, e.g., in a range from about 20 to about 70 kHz. As described above the drilling riser may have a diameter of about 20 inches such that an acoustic signal path from the transmitter to the receiver is 30 or more inches. High frequency acoustic signals (e.g., greater than 100 kHz) are known to be highly attenuated after traveling only a few inches in heavy drilling fluid and thus may be unsuitable.

The transmitters and receivers may advantageously be configured to have a large/wide main lobe of transmitted or received energy (i.e., to have a large beam width), for example, greater than about 45 degrees, or even greater than about 60 or 75 degrees. This may be accomplished, for example, via using a large diameter transducer (e.g., about 5 cm or more) and a low frequency signal (e.g., as described above).

Figure 13:
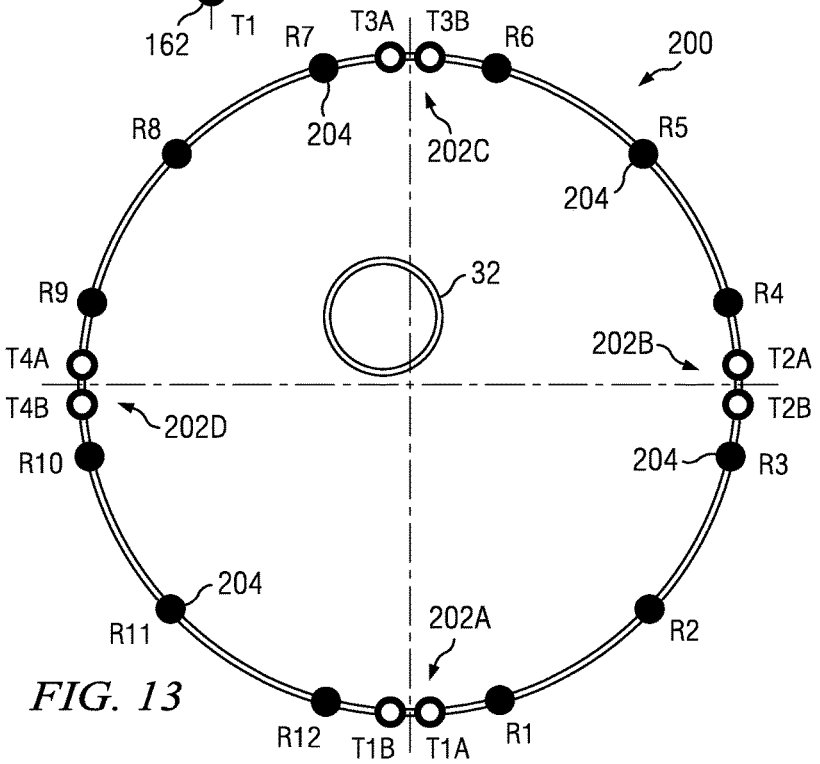
FIG. 13 depicts a cross sectional view of another alternative riser section embodiment including four transmitter groups and twelve receivers.

FIG. 13 depicts a cross sectional view of another alternative riser section embodiment 200 that includes four transmitter groups 202A-D and twelve receivers 204. Each of the receivers may include, for example, hydrophones having a piezoelectric transducer. In the depicted embodiment, the transmitter groups are located at 90 degree intervals about the circumference of the riser section while the receivers are spaced at 30 degree intervals (and are offset from the transmitters by 15 degrees). Each of the transmitter groups 202A-D includes first and second circumferentially spaced transmitters which are sized, shaped, and spaced to enable beam forming. For example, the diameter of each of the transmitters may be less than about one half of the wavelength of the transmitted acoustic energy. The transmitters may also be circumferentially spaced by less than one half of the wavelength.

During an acoustic measurement operation, the transmitters may be fired simultaneously when determining a location and diameter of the drill pipe 32. The detected signal at the receiver may be the sum of the two signals as the corresponding path-lengths for reflected signals are similar. However, for direct arrivals the two signals tend to be opposed in phase owing to the half wavelength spacing of the transmitters. Thus, direct arrivals tend to destructively interfere when the two transmitters are fired simultaneously. Such "beam forming" is intended to increase the signal to noise ratio of reflected signals and thereby improve the accuracy of the measurements. To obtain a sonic speed of the drilling fluid via a direct arrival only a single transmitter in the group may be fired. In another embodiment, a predefined delay may be used between transmitter firings to improve signal-to-noise in a selected direction.

With continued reference to FIG. 13, the use of four transmitter groups 202A-D advantageously provides for full coverage in the event that the drill pipe is off-center and blocks one of the transmitter groups. Moreover, the use of 12 receivers allows tubular detection over a wide range of geometric conditions (including a wide range of tubular geometries and center locations within the riser). Furthermore sonic speed determination may be obtained for direct paths at various angles (e.g., at 45, 75, and 105 degrees) such that the effect of destructive interference on the measurements can be mitigated (or identified). The depicted configuration also provides for measurement redundancy and therefore tends to improves measurement accuracy and reliability.

While FIGS. 9-13 depict embodiments in which the transmitters and receivers are deployed in the same axial plane, it will be understood that additional receivers may be axially offset from the transmitter(s). For example, as depicted on FIG. 14, riser section embodiment 220 includes additional receivers deployed in axial planes B, C, D, and E. These planes may be axially offset from plane A (which includes the transmitters for example, as described above with respect to FIGS. 9-13). The axial planes B, C, D, and E (including additional receivers) may be axially spaced from plane A, for example, by a distance in the range from about 6 to about 24 inches (e.g., at an axial spacing of 15 inches as in the example embodiment). Moreover, in each of planes B, C, D, and E the receivers may be deployed in the same circumferential pattern as depicted on FIG. 13 (e.g., twelve receivers spaced at 30 degree intervals about the periphery of the riser), although the disclosed embodiments are of course not limited in this regard. The use of axially spaced receivers provides further data redundancy and also allows for the reception of acoustic energy having longer time delays. Such increased time delays may advantageously provide for better characterization of the tubular size and location as well as the sonic speed of drilling fluid in the riser.

Figure 14:
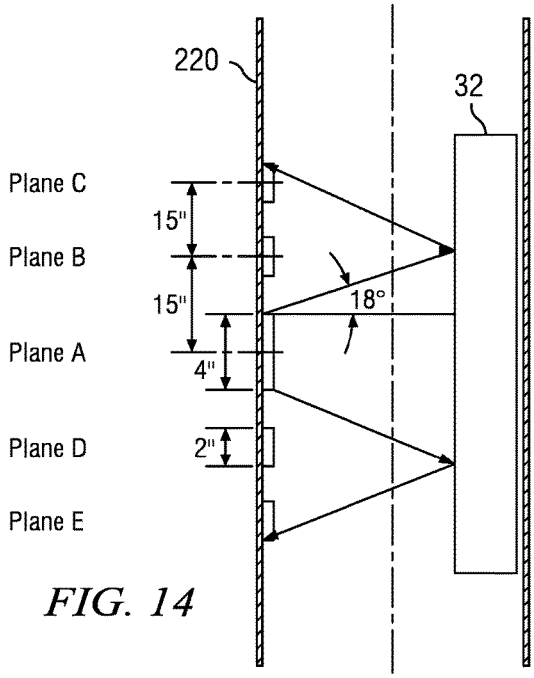
FIG. 14 depicts a longitudinal cross sectional view of yet another riser section embodiment including multiple axial receiver planes.

With continued reference to FIG. 14, it will be understood that the receiver spacing in the axially spaced planes (e.g., planes B, C, D, and E) need not be identical to the spacing in the primary plane (e.g., plane A). For example, in certain embodiments fewer receivers may be deployed in the axially spaced planes. Moreover, there is no limit to the number of axially spaced planes upon which additional receivers may be deployed. Nor is there any requirement that the receivers be deployed on an even number of axially spaced planes that are symmetric about the primary plane (however symmetric embodiments may be advantageous).

As described above, the transmitters may be configured to transmit acoustic energy at a base frequency in a range from about 20 to about 70 kHz. The transmitters may be further configured such that they may be operated at first and second frequencies, the base frequency in the range from about 20 to about 70 kHz and a supplemental frequency that is about twice the base frequency. During an acoustic measurement operation each transmitter group may be fired sequentially, for example, in a rotary sequence about the circumference of the riser. The firing interval may be on the order of a few milliseconds, for example, in a range from about 2 to about 5 milliseconds. After a predetermined number of rotary sequences, an alternative sequence may be implemented to determine the sonic speed of the riser fluid. The alternative sequence may be substantially identical to the sequence described above with the exception only one transmitter per transmitter group is fired. In each of these sequences, the receivers and the associated electronics may be configured to receive acoustic waves corresponding to each of the transmitter firings. The disclosed embodiments are, of course, not limited in any of these regards.

It will be understood that there may be some acoustic coupling between the transmitters and receivers in the steel wall of the riser section. Acoustic coupling between the transmitters and the steel wall may result in propagation of acoustic energy in the riser, thereby resulting in significant acoustic noise at the receivers. The acoustic energy may propagate in all directions in the riser, for example, in circular, axial, and spiral directions, which may result in multiple arrivals at each receiver. Moreover, both compressional and shear waves may propagate in the riser section such that there may be multiple compressional wave and shear wave arrivals at each of the receivers. Therefore it may be advantageous to configure the transmitters and receivers, as well as the riser geometry to attenuate or otherwise mitigate such acoustic noise.

Figure 15A:
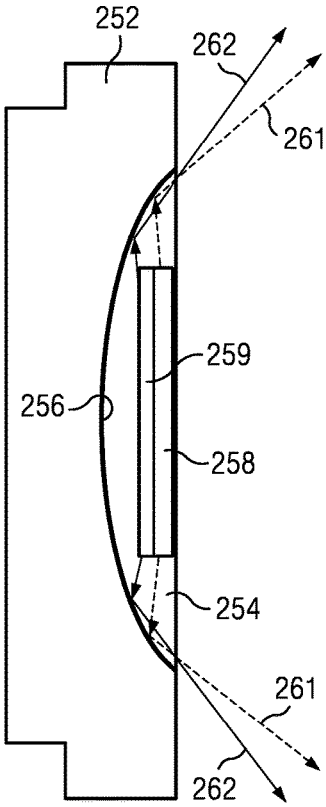
FIGS. 15A and 15B depict longitudinal and circular cross sections of example transmitter and receiver deployments in the steel wall of a riser section.
Figure 15B:
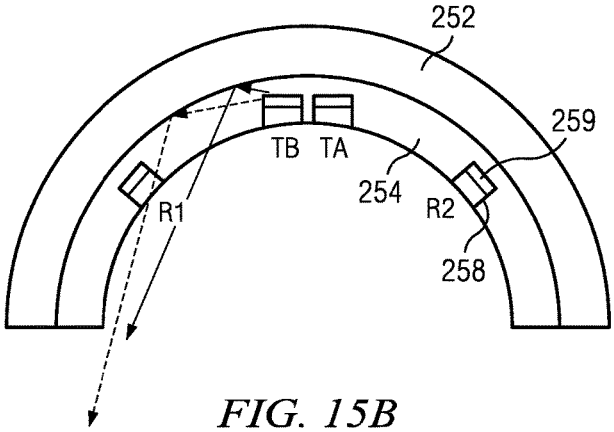

FIGS. 15A and 15B depict longitudinal and circular cross sections of example transmitter TA, TB and receiver R1, R2 deployments in the steel wall 252 of a riser section. The transmitters and receivers are preferably configured such that they have minimal acoustic coupling with the riser wall 252. For example, in the depicted embodiments, the transmitters TA, TB and receivers R1, R2 may be deployed in a highly attenuating, low impedance material 254 such as rubber. Such deployment tends to significantly reduce acoustic coupling between the transmitter TA, TB and/or receiver R1, R2 and the steel wall 252 of the riser section.

As further depicted on FIGS. 15A and 15B, the "pocket" 256 in which the transmitters and receivers are deployed may be shaped so as to limit transmission of acoustic energy into the steel wall. For example, in the depicted embodiment, the pocket 256 has a contoured (rounded) surface such that the acoustic energy that propagates through the rubber attenuator 254 tends to be reflected away as depicted at 261 and 262. Such a design may efficiently limit coupling between the signal generated by the cross-axis coupling at the transmitter (which is a characteristic of the piezoelectric material) and the wall of the riser.

The transmitters TA, TB and receivers R1, R2 may be further configured such that a heavy and/or dense backing layer 259 is deployed behind the piezoelectric sensor 258 (transducer). When deployed on a transmitter, the backing layer 259 is intended to promote front surface motion and attenuate back surface motion of the transducer 258 such that most of the acoustic energy emanates from the front surface (i.e., into the riser fluid). The backing layer 259 may preferably include or be fabricated from a dense material such as tungsten.

The transmitters TA, TB and receivers R1, R2 may be further configured to minimize shear wave transmission and reception in the riser wall. For example, the transmitters and receivers may be sized and shaped such that their axial length is a multiple of the shear wave wave-length. Such a construction tends to minimize transmission and reception of the shear waves.

Figure 16A:
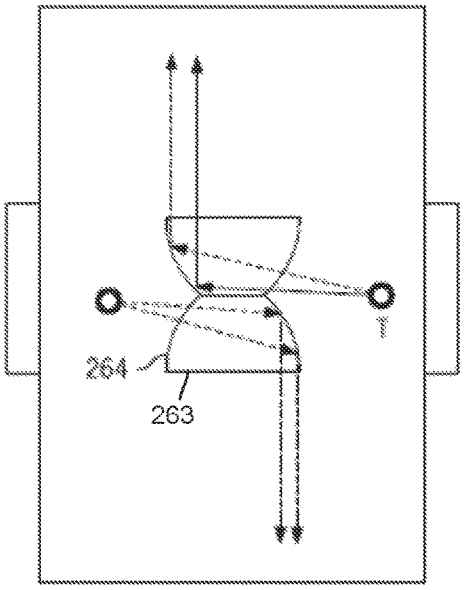
FIGS. 16A and 16B depict external structures on one riser section embodiment.
Figure 16B:
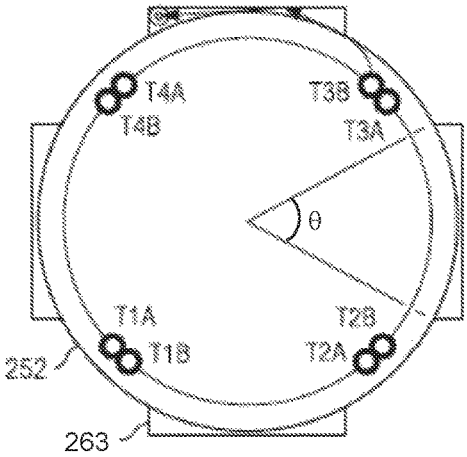

FIGS. 16A and 16B depict external ribs 262 that may be attached to or integral with an external surface of the riser wall 252. In the depicted embodiment, the ribs 263 are deployed circumferentially between the transmitter groups T1AB-T4AB (e.g., circumferentially offset from the transmitter groups by 45 degrees). Moreover, the ribs 263 may advantageously have a circumferential extent θ of at least 30 degrees (e.g., 45 degrees). The ribs further employ a curved (e.g., parabolic) circumferential surface 264 such that the rib redirects (reflects) acoustic energy in an axial direction away from the receivers (where it tends to dissipate along the length of the riser).

Figure 17:
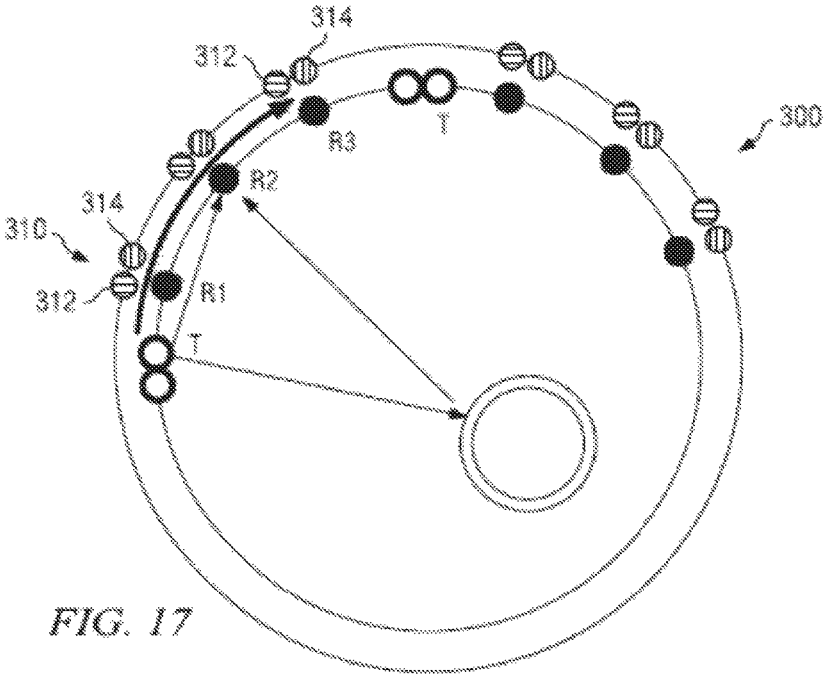
FIG. 17 depicts another alternative embodiment in which accelerometers are deployed in the riser section at the same circumferential locations as the receivers.

FIG. 17 depicts another alternative riser section embodiment 280 in which accelerometers 290 are deployed in the riser section at the same circumferential locations as the receivers (e.g. spaced from the transmitter groups by angles of 15, 45, and 75 degrees). Each accelerometer package may include first and second accelerometers 292, 294, a first with an axis parallel to the riser axis such that it is sensitive to shear waves and a second with an axis perpendicular to the riser axis (tangent to the circumference) such that it is sensitive to longitudinal waves. As described in more detail below such accelerometers may be used to detect and thereby cancel acoustic arrivals in the steel riser section 290. The exterior of the riser section 290 may also be coated, for example, with a material that promotes dissipation of any acoustic energy in the riser wall. For example, cement or cement loaded with hematite may promote such dissipation.

Detection of Drill String Components

Figure 18:
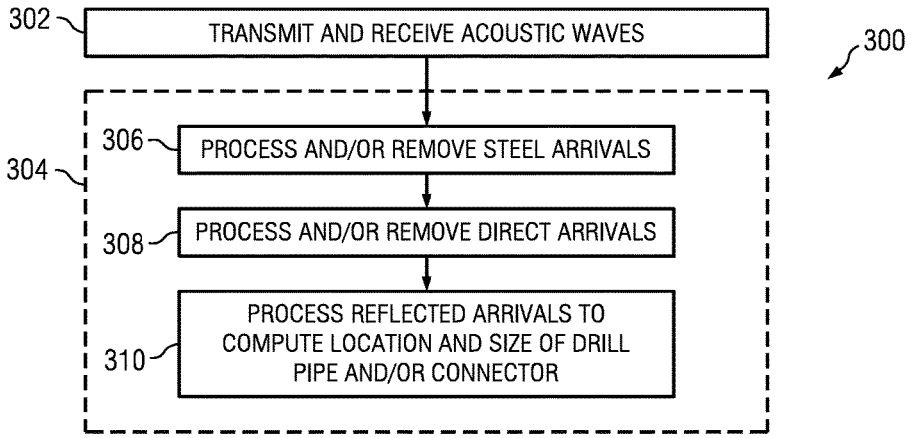
FIG. 18 depicts a flow chart of one example method embodiment for detecting a drill string in a riser section.

FIG. 18 depicts a flow chart of an example method embodiments 300 for detecting a drill string in a riser section. At 302, acoustic waves are transmitted via one or more acoustic transmitters and received at a plurality of acoustic receivers in a drilling riser section (e.g., using one of the riser embodiments described above with respect to FIGS. 5-17. At 304, the received acoustic energy is processed to determine the location and size (diameter) of the drill pipe and/or drill pipe connection in the riser section. The received acoustic energy may include various modes, for example, including longitudinal and/or shear waves in the riser wall (referred to as steel arrivals), direct arrivals from the transmitter to the receiver traveling in the fluid (referred to as direct arrivals), near wall waves traveling in the fluid near the riser wall (referred to as near wall arrivals), and acoustic energy reflected off the drill pipe (referred to as reflected arrivals). The processing in 304 may include, for example, processing and/or removing the steel arrivals at 306, processing and/or removing the direct arrivals and near wall arrivals at 308, and processing the reflected arrivals at 310 to locate the drill pipe and/or drill pipe connection in the riser section.

The reflected arrivals received at a plurality of receivers (e.g., three or more) may be processed at 310 to compute corresponding ellipses based upon the time of flight of each reflected arrival. The location and diameter of the drill pipe (or connection) may be obtained by minimizing the distance error between the drill pipe and the set of ellipses. The minimum error may be computed by iterating a center position and a drill pipe diameter over a predetermine range of values and computing the error at each position, for example, according to the following equation:

$$\text{Error}=\sqrt{\Sigma e_i^2} \tag{3}$$

where $e_i$ represents the distance error between the drill pipe and the i-th ellipse.

When a non-circular tubular (e.g., a stabilizer with blades) is detected by the acoustic sensor 101, the multiple ellipses as shown in FIG. 9 may not match a specific cylinder diameter. Furthermore, the stabilizer blades may reflect acoustic energy towards a receiver not consistent with the ellipses described above with respect to FIG. 7. Such a situation may result in an increased error as described above. When such error reaches a certain threshold, the processing may indicate that the tubular may not be cylindrical.

Despite the use of transmitter and/or receiver isolation mechanisms (such as described above with respect to FIGS. 15A and 15B) the received acoustic energy may include one or more steel arrivals. As is known to those of ordinary skill in the art, the acoustic speed of compressional and shear waves in steel (e.g. in the riser section wall) is several times greater than the acoustic speed in the riser fluid. For example, the acoustic speed in the fluid may be on the order of about 1500 m/s, while the compressional wave velocity in steel may be on the order of 6000 m/s and the shear wave velocity in steel may be on the order of about 3000 m/s. As such, steel arrivals may generally be received before other fluid arrivals (e.g., the direct and reflected arrivals).

Figure 19:
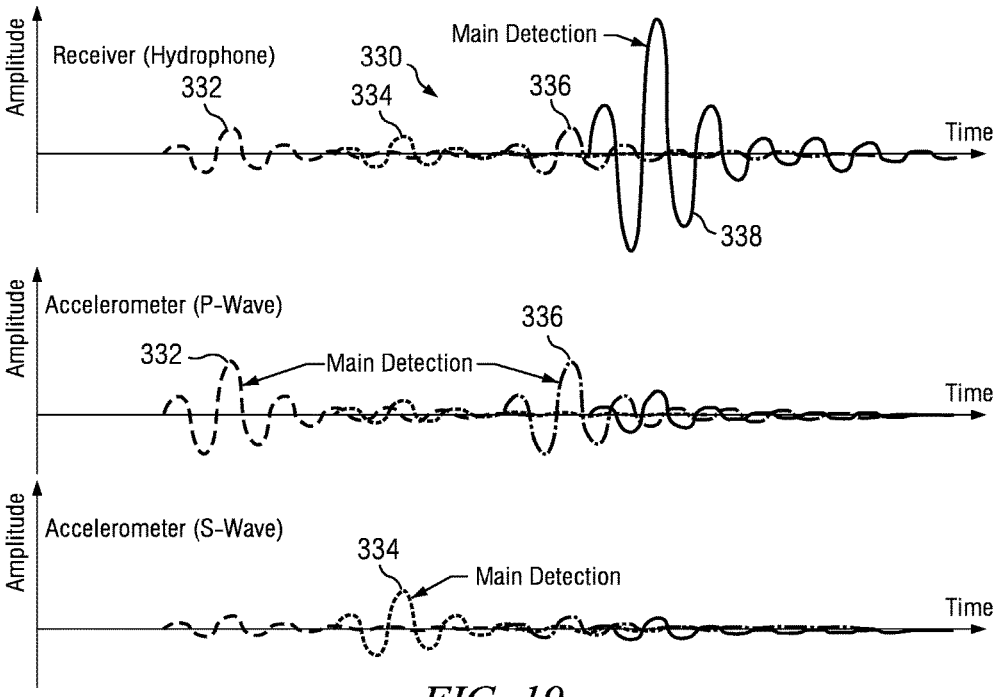
FIG. 19 depicts example waveforms received via a piezoelectric transducer and corresponding accelerometers.

FIG. 19 depicts example waveforms received at a receiver for an example embodiment in which a transmitter is circumferentially spaced from a receiver by 90 degrees. The received waveform 330 (e.g., received by a hydrophone receiver) may include compressional and shear wave arrivals 332 and 334 as well as a compressional arrival 336 that travels in the opposite direction about the riser (270 degrees between the transmitter and receiver). It will be understood that other steels arrivals may also be present at other arrival times, for example, as the acoustic energy repeatedly circles the riser. As also depicted, these steel arrivals may interfere with a direct fluid arrival 338 as well as reflected fluid arrivals (the reflected fluid arrival is not shown in the depicted example).

Corresponding accelerometers (e.g., as depicted on FIG. 17) may also be used to detect the steel arrivals 332, 334, and 336. These accelerometer-received arrivals may be used to cancel (or minimize) the steel arrivals in the received waveform 330. For example, the compressional and steel arrivals received at the accelerometers may be processed to obtain an out of phase signal that dynamically cancels the steel arrivals in the received waveform. Such noise cancellation may be performed, for example, via minimizing the RMS signal in following equation:

$$E = \frac{1}{T_2 - T_1}\int_{T_1}^{T_2} (R_{cv}(t) - K \cdot Accel\beta(t - \Delta t))^2 \, \partial t \tag{4}$$

where E represents the energy of the received signal, $R_{cv}(t)$ represents the output of the receiver at time t, Accel(t) represents the output of the accelerometer(s) at time t, K represents the coupling coefficient of the receiver—which is essentially a gain term, β depends on the propagation delay for wave travelling in the steel in relation to the wave travelling in the fluid, Δt represents the corresponding phase response of the coupling, and $T_1$ and $T_2$ represent first and second reception times prior to the reception time of any fluid arrivals. In practice, the coupling coefficient K may be adjusted to cancel (or minimize) E.

Semblance processing may also be used to distinguish between the steel arrivals, the direct fluid arrival, and the reflected arrivals. As depicted on FIG. 20, semblance processing compares the received signals at multiple receivers. In conventional acoustic logging operations, the multiple receivers are axially spaced along the logging while drilling tool body. In the acoustic measurements described herein, the acoustic receivers may be both circumferentially and axially spaced along the riser (e.g., as described above with respect to FIGS. 13 and 14).

Figure 20:
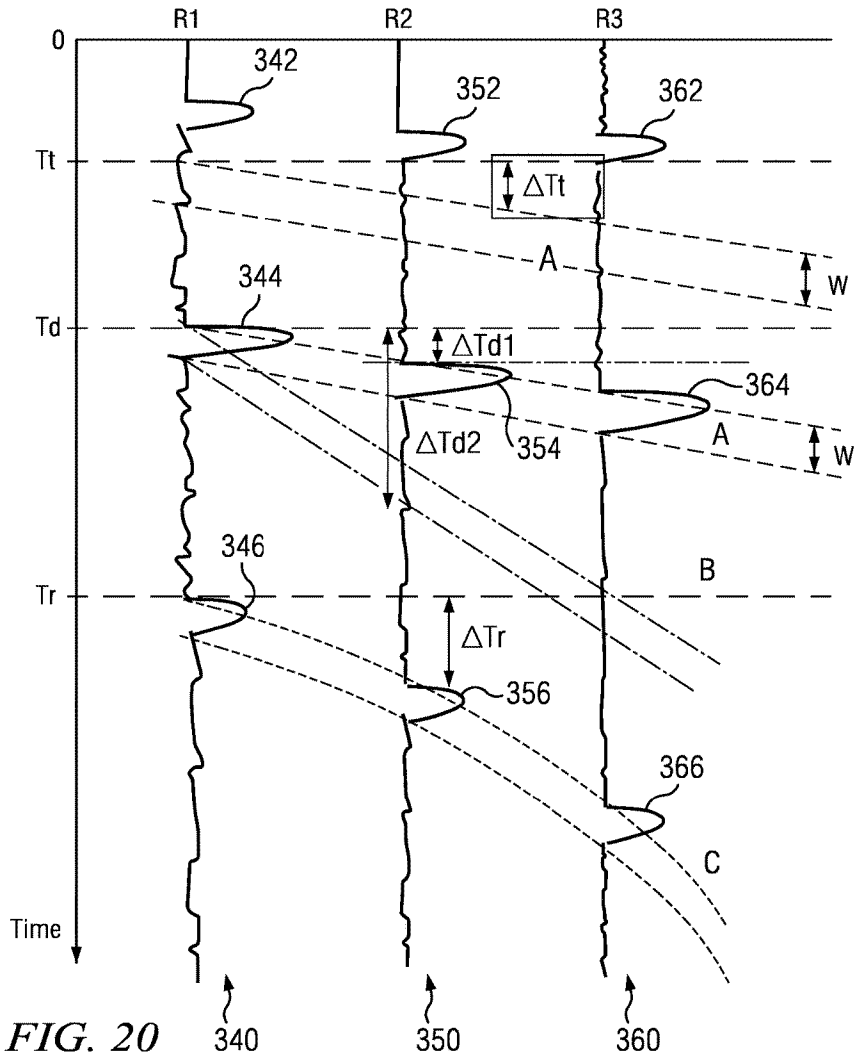
FIG. 20 depicts example waveforms received at circumferentially spaced receivers.

In FIG. 20 received waveforms 340, 350, and 360 are schematically depicted as received at first, second, and third circumferentially spaced receivers R1, R2, and R3. As depicted, each waveform may include a steel arrival 342, 352, 362, a direct arrival 344, 354, 364, and a reflected arrival 346, 356, 366. The semblance processing may involve correlating the received signals in a given time window w between adjacent receivers along the circumference of the riser. For example, a correlation value may be computed at each window position as the time window w is incrementally moved along the time axis (e.g., by time increment Δt). Due to the circular geometry, the window for the reflected arrival may be curved (either convex or concave), where the curvature is related to the acoustic path length between the transmitter and receivers. Since the relative path lengths depend on both the center position and the diameter of the drill pipe, these parameters may be computed via obtaining the best correlation value. For example, the center position and the diameter of the drill pipe may be iterated until a best fit is found between the window curvature and the acoustic receiver waveforms.

It will be understood that the computed correlation coefficients may be mapped using a semblance map (a contour plot of computed correlation values plotted versus the time increment Δt on the vertical axis and time T on the horizontal axis). The contour plot may define correlation contours indicative of the locations of the best matches for the various signal components (e.g., the steel arrival, the direct arrival, and the fluid arrival). The peak of the direct arrival may then be used to compute fluid velocity, while the peak for the peak of the reflected arrival may be used to compute the center position and diameter of the drill pipe in the riser.

Semblance processing may also be employed for riser embodiments employing multiple receiver planes (e.g., as depicted on FIG. 14). For example, the arrival times of signals obtained from axially spaced (and circumferentially aligned) receivers may be correlated using semblance processing techniques. Such processing may advantageously enable the length of the incident and reflected acoustic waves as well as the offset time due to phase delays in the transmitters and receivers to be computed.

Figure 21:
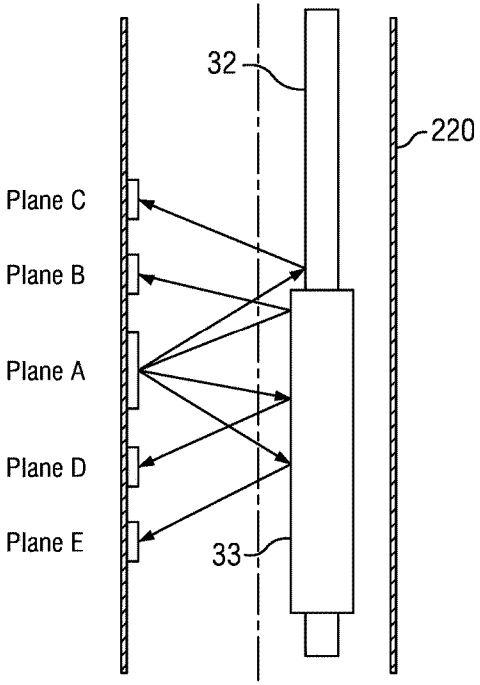
FIG. 21 depicts a longitudinal cross sectional view of acoustic energy reflecting off a tubular to multiple axial receiver planes.

As depicted on FIG. 21, the acoustic energy reflected from the tubular may not all come from the same tubular section (e.g., as depicted acoustic energy received in plane C is reflected by the drill pipe 32 while the energy received in the other planes is reflected by the connection 33). Such signal mixing may result in errors if not properly accounted. One way to account for such a possibility is to employ symmetrically spaced receiver planes (i.e., such that planes C and E are equi-spaced from plane A and planes B and D are equi-spaced from plane A). The time of flight may then be compared for the symmetric planes. If the difference is greater than some pre-determined threshold the data may be indicative of a nearby intersection between drill pipe and connection).

Although acoustic detection of drill pipe connections in a drilling riser and certain advantages thereof have been described in detail, it should be understood that various changes, substitutions and alternations can be made herein without departing from the spirit and scope of the disclosure as defined by the appended claims.

What is claimed is:

1. A system for drilling an offshore well, the system comprising;

a drill string including a plurality of drill pipes connected to one another deployed in a drilling riser, the drilling riser extending from an offshore drilling platform to a blowout preventer located at the sea floor, the drilling riser including a plurality of elongated riser sections connected end to end, an electrical transmission line extending along the plurality of riser sections;

at least one of the riser sections including a plurality of circumferentially spaced acoustic transmitters and a plurality of circumferentially spaced acoustic receivers, the transmitters and receivers in electronic communication with a processor located on the drilling platform via the electrical transmission line;

the processor configured to process acoustic waveforms at the receivers to compute a location and a diameter of drill pipe adjacent to the receivers.

2. The riser system of claim 1, wherein each of the transmitters comprises a transmitter group including first and second circumferentially spaced transmitters configured to be fired simultaneously or with a predetermined firing delay, the first and second transmitters circumferentially spaced by less than one half wavelength of said transmitted acoustic energy.

3. The riser system of claim 2, wherein the receivers have a circumferential spacing of 60 degrees or less.

4. The system of claim 1, wherein the transmitters and receivers are located in a lowermost one of the riser sections.

5. The system of claim 1, wherein the transmitters and receivers are located at least a length of one drill pipe above the blowout preventer.

6. The system of claim 1, wherein the transmitters and receivers are located an integer number of drill pipe lengths above the blowout preventer.

7. The system of claim 1, wherein the receivers are deployed on at least first, second, and third axially spaced planes on the riser section.

8. The system of claim 7, wherein the transmitters are deployed on the second plane and the first and third plane are symmetrically spaced about the second plane.

9. The system of claim 1, wherein the processor is configured to (i) remove at least one steel arrival from the received waveforms, (ii) process a direct arrival in the received waveforms to compute a velocity of acoustic energy drilling fluid in the drilling riser, and (iii) process a reflected arrival to compute the location and a diameter of the drill pipe.

10. The system of claim 9, wherein (iii) further comprises (iiia) define a plurality of ellipses based upon time of flight measurements for a corresponding plurality of said reflected arrivals and (iiib) determine the location and the diameter of the pipe as a location and a diameter of a circle tangent to the plurality of ellipses.

11. A system for determining a location and a diameter of a pipe deployed in a bore, the system comprising:

a plurality of circumferentially spaced acoustic transmitters and a plurality of circumferentially spaced acoustic receivers deployed in a wall of the bore, the transmitters configured to transmit acoustic energy into the bore and the receivers configured to receive acoustic energy from bore; and a processor configured to process acoustic waveforms at the receivers to compute a location and a diameter of the pipe adjacent to the receivers.

12. The system of claim 11, wherein the bore is disposed in a drilling riser, a lower marine riser package, or a blowout preventer and the pipe is a drill pipe.

13. The system of claim 12, wherein the processor is further configured to identify a drill pipe connection when the diameter of the pipe is greater than a predetermined threshold diameter.

14. The system of claim 12, wherein the processor is further configured to identify a drill pipe connection based upon a change in the diameter of the pipe when the pipe is moved axially in the bore.

15. The system of claim 11, wherein the processor is configured to (i) define a plurality of ellipses based upon time of flight measurements for a corresponding plurality said received acoustic waveforms and (ii) determine the location and the diameter of the pipe as a location and a diameter of a circle tangent to the plurality of ellipses.

16. The system of claim 15, wherein the processor is further configured to minimize and error function in (ii) to determine the location and the diameter of the pipe.

17. The system of claim 11, wherein the transmitters and the receivers are configured to have a main lobe of transmitted or received energy of greater than 45 degrees.

18. The system of claim 11, wherein each of the transmitters comprises a transmitter group including first and second circumferentially spaced transmitters configured to be fired simultaneously or with a predetermined firing delay, the first and second transmitters circumferentially spaced by less than one half wavelength of said transmitted acoustic energy; and the receivers have a circumferential spacing of 60 degrees or less.

19. The system of claim 11, wherein the receivers are deployed on at least first, second, and third axially spaced planes on the wall of the bore;

the transmitters are deployed on the second plane; and the first and third plane are symmetrically spaced about the second plane.

* * * * *